United States Patent [19]

Sheffield

[11] Patent Number: 4,974,525

[45] Date of Patent: Dec. 4, 1990

[54] FOLDING TABLE APPARATUS

[76] Inventor: Richard R. Sheffield, 3603 Hancock St., Amarillo, Tex. 79109

[21] Appl. No.: 486,287

[22] Filed: Feb. 28, 1990

[51] Int. Cl.[5] ..... A47B 3/02

[52] U.S. Cl. ..... 108/118; 108/157; 248/164

[58] Field of Search ..... 108/118, 157; 211/200; 248/432, 164; 403/79, 157, 158, 159

[56] References Cited

U.S. PATENT DOCUMENTS

| | | | |
|---|---|---|---|
| 164,386 | 6/1975 | Merrick | 248/164 |
| 812,011 | 2/1906 | Brode | 211/200 |
| 1,289,247 | 12/1918 | Pamporin | 248/164 |
| 2,499,030 | 2/1950 | Moon | 403/79 K |
| 2,829,934 | 4/1958 | Schulze | 108/157 |
| 3,157,136 | 11/1964 | Moody | 108/118 X |
| 4,029,318 | 6/1977 | Boss | 108/118 X |
| 4,290,532 | 9/1981 | Reynolds | 211/200 |
| 4,763,865 | 8/1988 | Dannor | 108/118 X |

FOREIGN PATENT DOCUMENTS

| | | | |
|---|---|---|---|
| 1135081 | 5/1957 | France | 108/118 |

*Primary Examiner*—Jose V. Chen
*Attorney, Agent, or Firm*—Leon Gilden

[57] ABSTRACT

A table apparatus including a plurality of plural leg pairs mounted in a scissor-like relationship relative to each other, including an elongate, tubular polymeric member mounted to an upper horizontal support member associated with each leg pair. A tether line is mounted to secure opposing legs of associated leg pairs relative to one another. A modification of the table apparatus includes each leg of each leg pair formed with a bifurcated upper end adjustably mounting a "U" shaped member thereto to permit height adjustment of the table apparatus.

1 Claim, 4 Drawing Sheets

PRIOR ART

FIG. 5
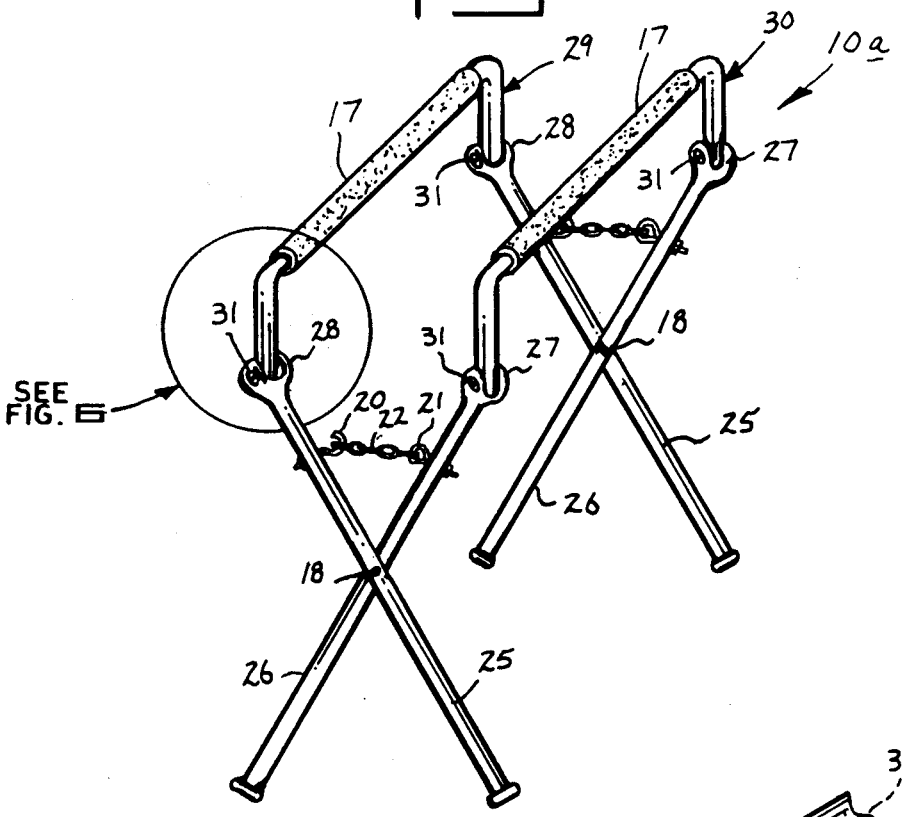
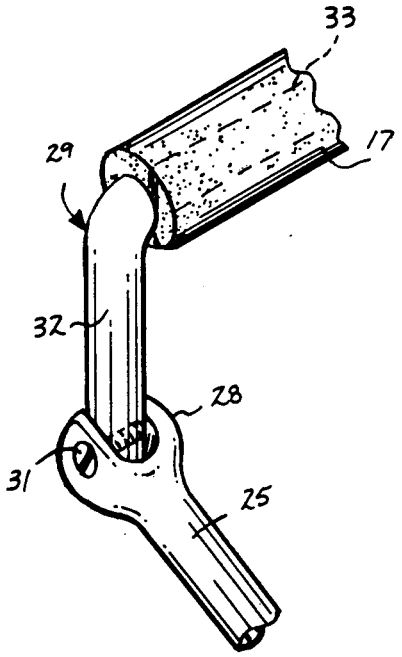
FIG. 6

FOLDING TABLE APPARATUS

BACKGROUND OF THE INVENTION

1. Field of the Invention

The field of invention relates to table apparatus, and more particularly pertains to a new and improved folding table apparatus wherein the same is readily secured during periods of non-use and easily extended for operative engagement with a table surface.

2. Description of the Prior Art

Folding tables of various types have been set forth in the prior art. Folding tables are conveniently utilized by individuals wherein such tables are space efficient and are easily stored. Advantages of the instant invention include a structurally arranged table for strength and compactness of storage and use. Examples of the prior art include U.S. Pat. No. 3,157,136 to Moody providing a folding table with a plural pair of elongate loops operative as a support base and a lowermost end to mount the table to a table top and an underlying support surface.

U.S. Pat. No. 4,763,865 to Danner provides a support stand defined by crossed eye-shaped members, wherein the eye shaped members include spaced resilient tubes thereon for securement of a keyboard thereon.

U.S. Pat. No. 4,210,085 to McLravy, et al., provides for a folding table wherein a central hinge plate mounts a multi-leg structure to support an overlying table top.

U.S. Pat. No. 4,061,305 to Beekenkamp sets forth a portable work table wherein the support stand for the work table includes pivotally mounted crossed legs for support of the overlying work table structure.

U.S. Pat. No. 3,106,295 to Berlin is another example of a crossed "U" shaped leg structure to mount a table thereon.

As such, it may be appreciated that there continues to be a need for a new and improved folding table apparatus wherein the same addresses both the problems of ease of use, as well as effectiveness in construction and the storage, and geometric integrity in construction of a folding table and in this respect, the present invention substantially fulfills this need.

SUMMARY OF THE INVENTION

In view of the foregoing disadvantages inherent in the known types of folding table apparatus now present in the prior art, the present invention provides a folding table apparatus wherein the same includes crossed leg members utilizing a flexible interlocking tether construction to maintain the crossed legs in a predetermined orientation relative to one another. As such, the general purpose of the present invention, which will be described subsequently in greater detail, is to provide a new and improved folding table apparatus which has all the advantages of the prior art folding table apparatus and none of the disadvantages.

To attain this, the present invention provides an apparatus including a plurality of plural leg pairs mounted in a scissor-like relationship relative to each other, including an elongate, tubular polymeric member mounted to an upper horizontal support member associated with each leg pair. A tether line is mounted to secure opposing legs of associated leg pairs relative to one aother. A modification of the invention includes each leg of each leg pair formed with a bifurcated upper end adjustably mounting a "U" shaped member thereto to permit height adjustment of the table organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved folding table apparatus which has all the advantages of the prior art folding table apparatus and none of the disadvantages.

It is another object of the present invention to provide a new and improved folding table apparatus which may be easily and efficiently manufactured and marketed.

It is a further object of the present invention to provide a new and improved folding table apparatus which is of a durable and reliable construction.

An even further object of the present invention is to provide a new and improved folding table apparatus which is susceptible of a low cost of manufacture with regard to both materials and labor, and which accordingly is then susceptible of low prices of sale to the consuming public, thereby making such folding table apparatus economically available to the buying public.

Still yet another object of the present invention is to provide a new and improved folding table apparatus which provides in the apparatuses and methods of the prior art some of the advantages thereof, while simultaneously overcoming some of the disadvantages normally associated therewith.

Still another object of the present invention is to provide a new and improved folding table apparatus wherein the same utilizes crossed pairs of folding legs to effect compact storage of the organization during periods of non-use, and further permits adjustment of a table top in association with the organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of a modification of the instant invention.

FIG. 6 is an isometric illustration as set forth in FIG. 5.

DESCRIPTION OF THE PREFERRED EMBODIMENT

Figure 1:
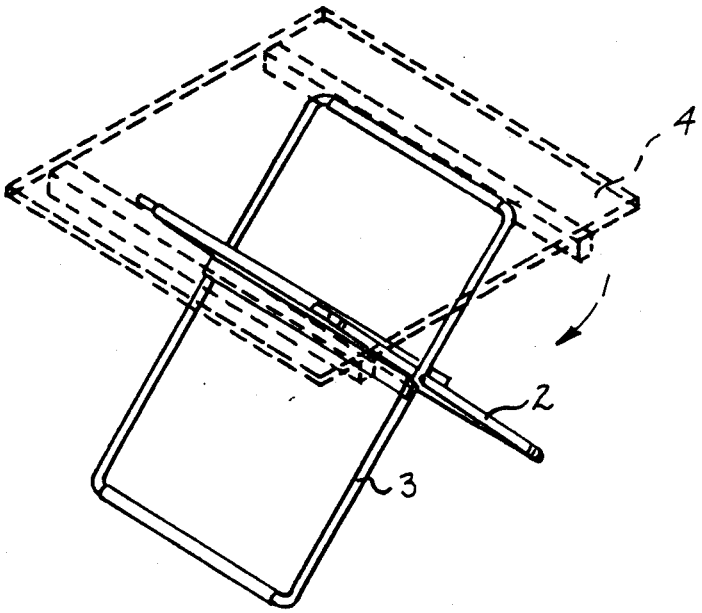
FIG. 1 is an isometric illustration of a prior art table apparatus.

With reference now to the drawings, and in particular to FIGS. 1 to 9 thereof, a new and improved folding table apparatus embodying the principles and concepts of the present invention and generally designated by the reference numerals 10 and **10*a*** will be described.

Figure 2:
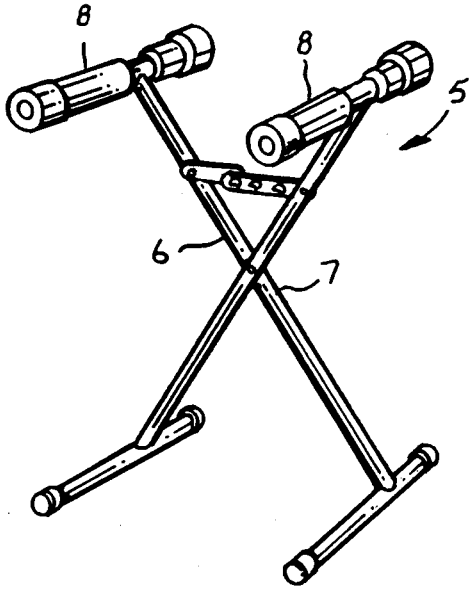
PRIOR ART FIG. 2
FIG. 2 is an isometric illustration of a further prior art folding table apparatus.

FIG. 1 illustrates a prior art folding table 1 wherein a first and second framework are pivotal relative to one another to provide support for an associated table top 4. FIG. 2 illustrates a further prior art folding table apparatus 5, wherein a first and second respective eye-shaped scissor arrangement 6 and 7 each mount a resilient plurality of tubular cushions 8 at an uppermost end thereof to support an elongate keyboard and the like, such as utilized in musical instrumentation.

Figure 3:
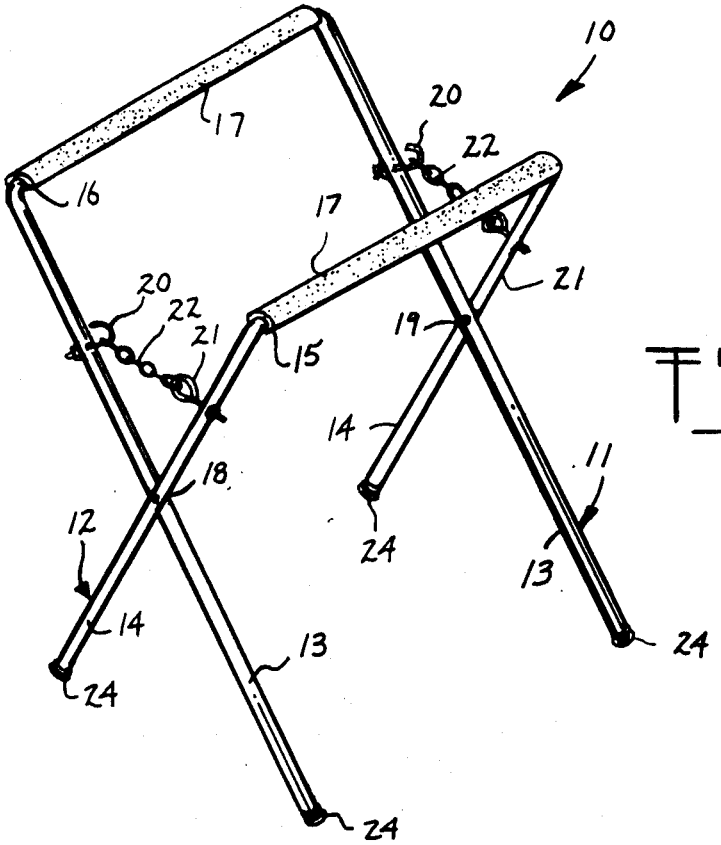
FIG. 3 is an isometric illustration of the instant invention.
Figure 4:
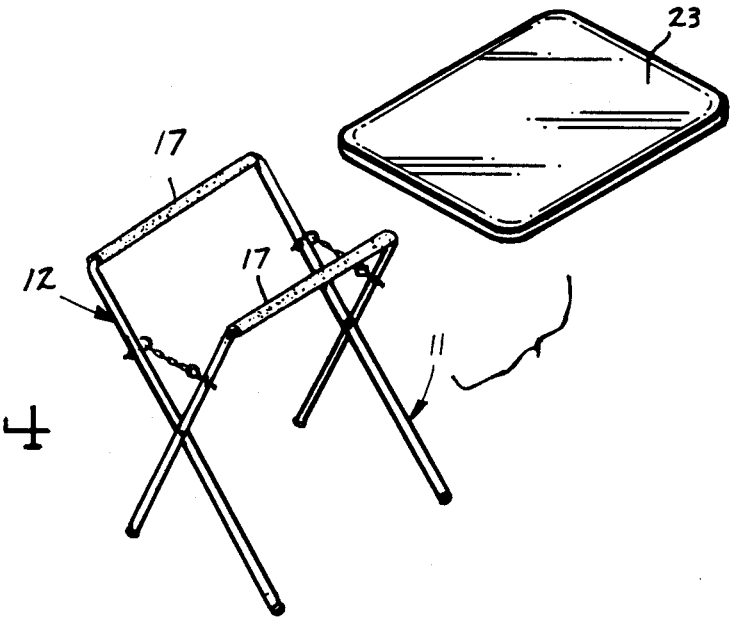
FIG. 4 is an isometric illustration of the instant invention in association with a table top structure.

More specifically, the folding table apparatus 10 of the instant invention essentially comprises a first "U" shaped brace 11 pivotally mounted to a second "U" shaped brace 12. The first "U" shaped brace 11 includes a first spaced pair of parallel frame legs 13 extending upwardly to an orthogonally and integrally mounted first support leg 15. The second "U" shaped brace organization 12 includes a pair of second spaced parallel frame legs 14 mounting a second support leg 16 orthogonally and integrally to upper terminal ends thereof. A coextensive polymeric tubular foam covering 17 is provided in surrounding relationship to the respective first and second support legs 15 and 16 for support of an associated planar table top 23, as illustrated in FIG. 4. A first and second coaxially aligned pivot axis 18 and 19 are directed medially through each of the legs of the first and second frame legs 13 and 14. Anchor hook 20 is mounted to an interior surface of each of the first frame legs 13 above a pivot axis 18 and 19 respectively cooperative with an anchor loop 21 capturing a tether line 22 therewithin that is selectively securable from the anchor loops 21 to the aligned anchor hooks 20 to maintain the table in geometrically stable configuration, as illustrated in FIGS. 3 and 4 for example. Swivel tips 24 are mounted to lower terminal ends of each of the legs 13 and 14 and are preferably formed with a friction surface to enhance adhesion to a support surface in use of the table.

FIG. 5 illustrates a modified folding table apparatus **10*a* wherein first spaced parallel legs 25 of an equal length are pivotally mounted to cooperating second legs 26 medially thereof. The first and second legs 25 and 26 are formed with respective first and second bifurcated upper ends 27 defining a slot therebetween, wherein the slots are in alignment relative to one another between pairs of bifurcated first and second upper ends, as illustrated in FIG. 5 for example. A through-extending threaded fastener 31 extends through the walls of the bifurcated ends threadedly received within an opening in an opposing wall to permit securement of a vertical leg 32 captured between each of the bifurcated upper ends, with the threaded fastener 31 extending through a lower terminal end of each of the vertical legs. The vertical legs 32 define spaced parallel legs of a respective first and second "U" shaped frame 29 and 30, as illustrated in FIG. 5, wherein the "U" shaped frames each include an upper horizontal connecting leg member between the vertical legs, wherein each of the upper horizontal leg members include the coextensive tubular covering 17 thereover. Pivotal adjustment of the vertical legs 32 within the respective bifurcated upper ends permits height adjustment of the respective horizontal legs and their associated tubular covering 17. The horizontal legs are illustrated by example in phantom as a horizontal leg 33 in FIG. 6**.

Figure 7:
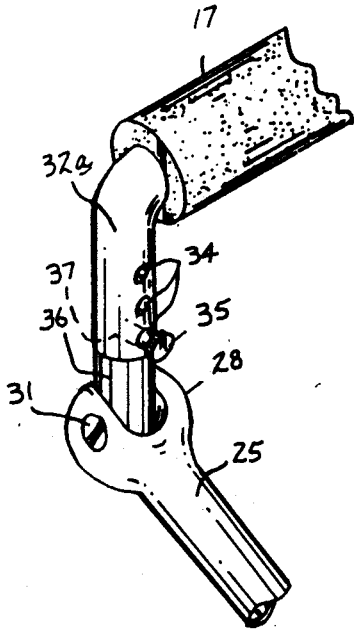
FIG. 7 is an isometric sectional illustration of a modification of the joint structure, as set forth in FIG. 5.

FIG. 7 illustrates a modified vertical leg **32*a*, wherein each of the modified vertical legs 32*a* include spaced aligned aperture pairs 34 cooperative with a positioning pin 35 that is selectively directed through a pair of the aperture pairs 34 cooperative with a positioning leg 36 that in turn is pivotally mounted to a bifurcated upper end. This permits a further length adjustment of each of the vertical legs in use, wherein the positioning pin 35 directed through an associated positioning leg aperture 37 telescopingly receives the modified vertical leg 32** relative thereto.

Figure 8:
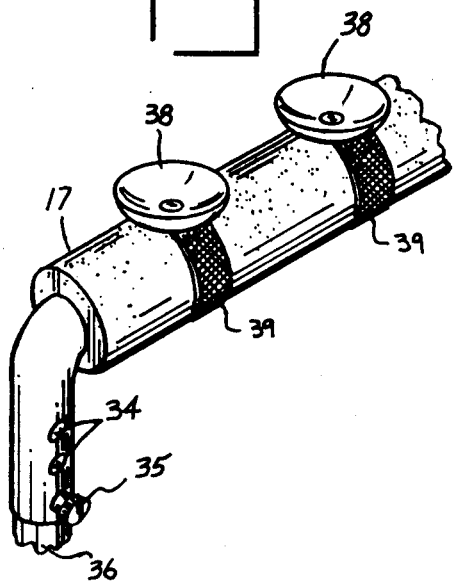
FIG. 8 is an isometric illustration of a further modification utilizing suction cup members to enhance securement of an associated table top.
Figure 9:
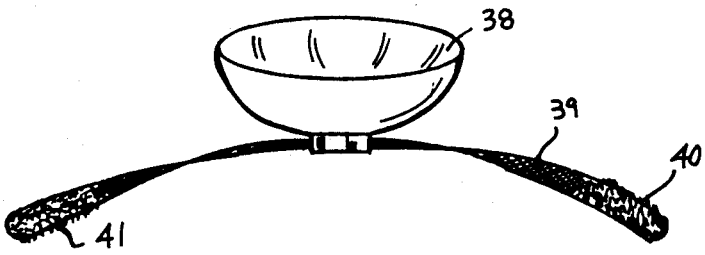
FIG. 9 is an isometric illustration of the suction cup structure utilized by the instant invention.

FIG. 8 illustrates an enhanced manner of securement of the associated planar table top 23 utilizing spaced resilient suction cups 38 mounted to an upper surface of each of the tubular coverings 17, wherein the suction cups 38 include flexible straps 39. The flexible straps 39 include respective first and second hook and loop fastener patches 40 and 41 mounted to opposed end portions of the flexible strap to permit surrounding engagement relative to the associated horizontal legs 33 and tubular covering 17.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters patent of the United States is as follows:

1. A folding table apparatus comprising, in combination, a planar table top, and a first leg pair and a second leg pair, each leg pair including a respective first leg and second leg, wherein each first and second leg is of a finite length, and each first and second leg is pivotally mounted about a common respective axle directed medially through each first and second leg of each respective first and second leg pair, and each first and second leg pair including a respective first and second table support means at an upper end of each first and second leg pair for securement of the planar table top thereon, and wherein each second leg includes a hook extending exteriorly thereof in confronting relationship to the respective second leg of each respective first and second leg pair, and each second leg of each respective first and second leg pair includes a loop in confronting relationship to the hook of the first leg of each respective first and second leg pair, and the hook including a flexible tether secured thereto for selective securement to the respective hook to secure the respective first and second leg pair in an extended orientation relative to one another, and wherein the hook and loop of each respective first and second leg pair is positioned above each respective axle, and wherein each first and second table support means includes a horizontal leg, and each horizontal leg includes a coextensive, polymeric tubular covering in surrounding relationship thereon, and wherein each upper terminal end of each first and second leg includes a bifurcated upper end, each bifurcated upper end of each first and second leg of each first and second leg pair is defined by a respective slot, wherein each slot of a first and second leg of each respective first and second leg pair is aligned relative to one another, and each slot receives a vertical leg pivotally therewithin, and wherein each bifurcated end includes a through-extending threaded fastener fixedly mounting in a selective orientation each vertical leg of each bifurcated upper end, and wherein each vertical leg includes a positioning leg slidably receivable thereon, each positioning leg includes a series of through-extending apertures therethrough, each of the series of the through-extending apertures is cooperative with a positioning pin, the positioning pin directed through one of the series of through-extending apertures and through the vertical leg for vertical positioning of the positioning leg relative to the vertical leg, and wherein each tubular covering and each horizontal leg is orthogonally mounted to a pair of positioning legs defining a "U" shaped member, and further including a plurality of suction cups selectively securable in surrounding relationship relative to each tubular covering, each of the suction cups includes a flexible strap selectively securable in surrounding relationship to the tubular covering, the flexible straps include a first and second end, and each first and second end includes a respective first and second hook and loop fastener patch, wherein each first and second hook and loop fastener patch is securable in engaging relationship for securement of a respective suction cup to the tubular covering.

* * * * *